US012465148B2

(12) United States Patent
Siao

(10) Patent No.: US 12,465,148 B2
(45) Date of Patent: Nov. 11, 2025

(54) MULTI-PURPOSE FOLDING CHAIR

(71) Applicant: JING SI PURELAND CO., LTD., Taipei (TW)

(72) Inventor: Marshall Q. Siao, Xincheng Township, Hualien County (TW)

(73) Assignee: JING SI PURELAND CO., LTD., Taipei (TW)

( * ) Notice: Subject to any disclaimer, the term of this patent is extended or adjusted under 35 U.S.C. 154(b) by 189 days.

(21) Appl. No.: 18/501,816

(22) Filed: Nov. 3, 2023

(65) Prior Publication Data

US 2024/0148150 A1 May 9, 2024

(30) Foreign Application Priority Data

Nov. 4, 2022 (TW) ..... 111142293

(51) Int. Cl.
*A47C 13/00* (2006.01)
*A47C 4/28* (2006.01)
*A47C 7/62* (2006.01)

(52) U.S. Cl.
CPC ..... *A47C 13/00* (2013.01); *A47C 4/283* (2013.01); *A47C 7/626* (2018.08)

(58) Field of Classification Search
CPC ..... A47C 13/00; A47C 4/283
See application file for complete search history.

(56) References Cited

U.S. PATENT DOCUMENTS

| | | | | |
|---|---|---|---|---|
| 1,653,469 | A * | 12/1927 | Perron | A47C 16/04 297/423.16 |
| 2,930,431 | A | 3/1960 | Geller | |
| 3,273,938 | A | 9/1966 | Jacobi | |
| 2016/0220026 | A1 * | 8/2016 | Siao | A47C 4/045 |

FOREIGN PATENT DOCUMENTS

| | | | |
|---|---|---|---|
| JP | S48-83904 | U | 10/1973 |
| JP | H05-46347 | U | 6/1993 |
| JP | 2017-536965 | A | 12/2017 |
| KR | 10-1107874 | B1 | 1/2012 |
| KR | 10-2013-0014854 | A | 2/2013 |
| TW | M492107 | U | 12/2014 |
| TW | M537847 | U | 3/2017 |

* cited by examiner

*Primary Examiner* — Anthony D Barfield
(74) *Attorney, Agent, or Firm* — ScienBiziP, P.C.

(57) ABSTRACT

A multi-purpose folding chair is provided. The chair includes two supporting side plates arranged in a corresponding configuration, two connecting plates, a seat plate, and a kneeling plate. Each of the two connecting plates is formed with a first folding line. The two connecting plates are arranged between the two supporting side plates and pivotally connected to the two supporting side plates, such that the two connecting plates are foldable in a flat manner along the first folding line. The seat plate is formed with a second folding line and is arranged between the two supporting side plates. Two sides of the seat plate respectively and pivotally connected to the two supporting side plates. The seat plate is foldable in a flat manner through the second folding line. The kneeling plate is formed with a third folding line and is arranged between the two supporting side plates.

8 Claims, 18 Drawing Sheets

10

10

200

300

400

500

MULTI-PURPOSE FOLDING CHAIR

CROSS-REFERENCE TO RELATED APPLICATION(S)

The present application claims the benefit of and priority to Taiwan Patent Application Serial No. 111142293, filed on Nov. 4, 2022, entitled "MULTI PURPOSE FOLDING CHAIR", the contents of which are hereby incorporated herein fully by reference into the present application for all purposes.

FIELD

The present disclosure generally relates to a chair and, more particularly, to a multi-purpose folding chair.

BACKGROUND

In Taiwan Patent Publication No. 517965, a chair includes a base unit and a chair back unit pivotally connected to the base unit. The base unit includes a first body, a second body with a height lower than the first body, a pair of first positioning portions outwardly arranged from opposite sides of the first body, and a pair of second positioning portions outwardly arranged from opposite sides of the second body. The chair back unit includes two support arms pivotable relative to the base unit. The chair back unit is capable of transitioning between a seated position and a kneeling position relative to the base unit. In the seated position, the support arms press against the first positioning portions and are spaced apart from the second positioning portions. In the kneeling position, the support arms press against the second positioning portions and are spaced apart from the first positioning portions.

Due to the ability of the chair to allow users to independently switch the chair back unit between the seated position and the kneeling position based on situational needs, it is particularly suitable for use in venues such as places of worship and preaching. However, this type of chair presents challenges in practical usage due to its heavy weight and large size, making it inconvenient for transportation. Furthermore, this type of chair could not reduce in size and usually takes up much storage space, thus there is room for improvements.

SUMMARY

In view of the above, it is necessary to provide a folding chair with better overall load capacity and convenient storage when not in use.

In a first aspect of the present disclosure, a multi-purpose folding chair is provided. A multi-purpose folding chair including two supporting side plates; two connecting plates, each of the two connecting plates formed with a first folding line, the two connecting plates arranged between the two supporting side plates and pivotally connected to the two supporting side plates, such that the two connecting plates are foldable in a flat manner along the first folding line; a seat plate formed with a second folding line, the seat plate arranged between the two supporting side plates, two sides of the seat plate respectively and pivotally connected to the two supporting side plates, and the seat plate is foldable in a flat manner through the second folding line; and a kneeling plate formed with a third folding line, two sides of the kneeling plate respectively and pivotally connected to the two supporting side plates, where at least one inner side of the two supporting side plates, the two connecting plates, the seat plate, or the kneeling plate is formed with a reinforcement structure, where each of the two supporting side plates is formed with a first rotating part, and the multi-purpose folding chair further comprises two armrest plates and a back plate, two ends of each of the two armrest plates are respectively formed with a second rotating part and a supporting part, the two armrest plates are respectively pivotally connected to the first rotating parts of the two supporting side plates through the second rotation parts, the back plate is formed with a fourth folding line, and the back plate is arranged between the two armrest plates, two sides of the back plate are pivotally connected to the supporting parts of the two armrest plates, the back plate is foldable in a flat manner along the fourth folding line, such that a distance between the two supporting side plates is reduced; an inner side of each of the two armrest plates is formed with a limiting part, the two supporting side plates each having a corresponding surface corresponding to the limiting part is formed with a corresponding limiting part with a curved track, the limiting part slides against the curved track formed by the corresponding limiting part, such that the two armrest plates are rotatable relative to the two supporting side plates along the curved track, and each of the two connecting plates is foldable in a flat manner along the first folding line, the seat plate is foldable in a flat manner along the second folding line, and the kneeling plate is foldable in a flat manner along the third folding line, such that the distance between the two supporting side plates is reduced.

In an implementation of the first aspect of the present disclosure, each supporting side plate is formed with a first top supporting part and a second top supporting part, the first rotating part is between the first top supporting part and the second top supporting part, each of the first top supporting part and the second top supporting part limits a rotation angle of one of the two armrest plates.

In an implementation of the first aspect of the present disclosure, each of the two connecting plates includes a first plate and a second plate, and each of the first plate and the second plate of each of the two connecting plates includes an inner side formed with the reinforcement structure.

In an implementation of the first aspect of the present disclosure, the kneeling plate comprises a first kneeling plate and a second kneeling plate, and an inner side of each of the first kneeling plate and the second kneeling plate is formed with the reinforcement structure.

In an implementation of the first aspect of the present disclosure, a kneeling plate reinforcement plate is pivotally connected between the two supporting side plates, such that one side of the kneeling plate presses against the kneeling plate reinforcement plate.

In an implementation of the first aspect of the present disclosure, the reinforcement structure includes a plurality of hexagonal reinforcement lattices arranged in a honeycomb shape; and a plurality of reinforcing ribs each intersects and connects between each of the plurality of hexagonal reinforcement lattices.

In an implementation of the first aspect of the present disclosure, at least one inner side of the two armrest plates and the back plate is covered with a reinforcing cover plate.

In an implementation of the first aspect of the present disclosure, a position where the two supporting side plates are pivotally connected to the kneeling plate comprises an inclination, the inclination is preferably at an angle of 8 degrees, and a plane of the kneeling plate is formed as an inclined plane after the kneeling plate is connected to the two supporting side plates.

DETAILED DESCRIPTION

Figure 1:
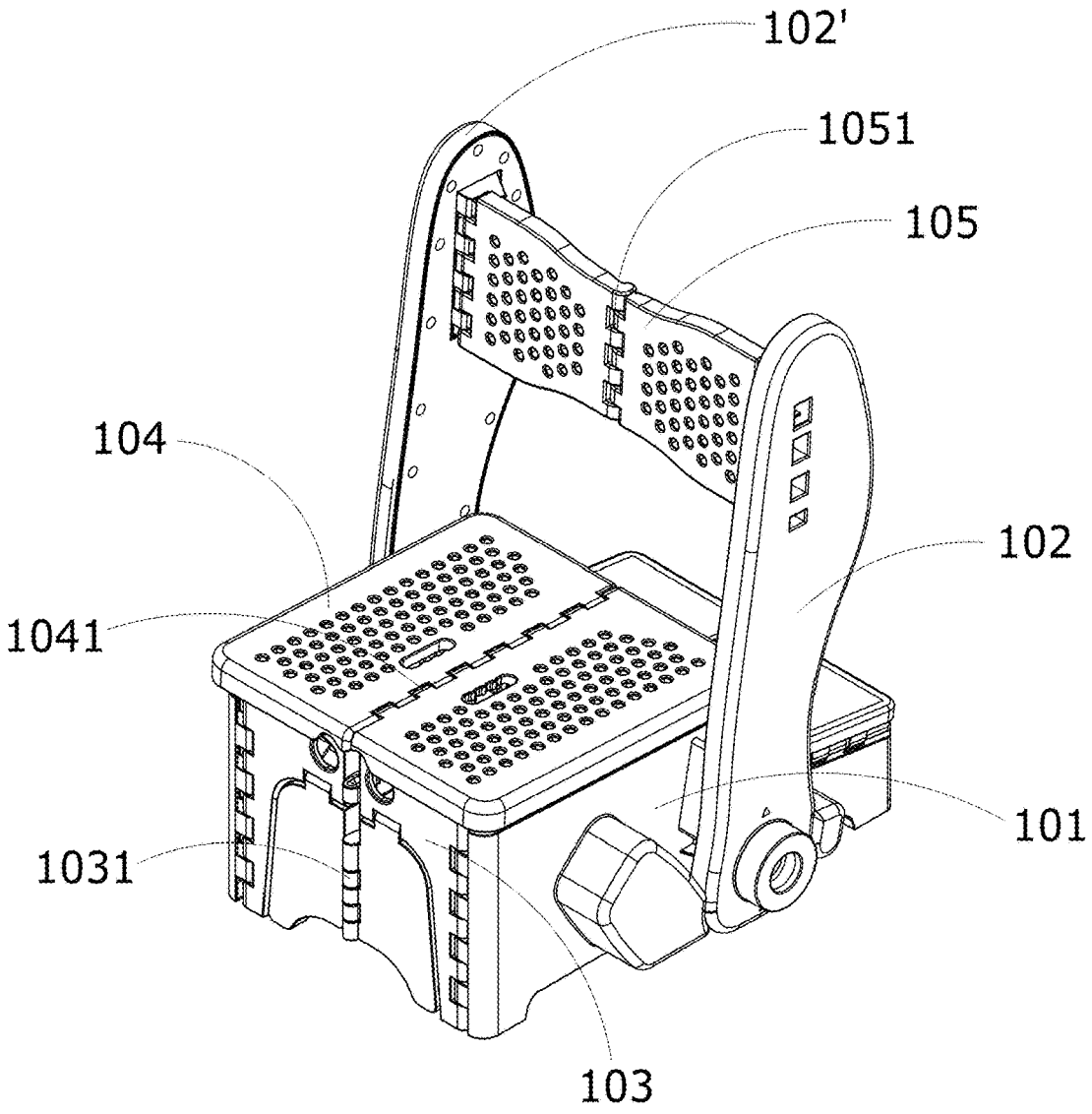
FIG. 1 illustrates a perspective view of a multi-purpose folding chair according to an example implementation of the present disclosure.

The following disclosure contains specific information pertaining to exemplary implementations in the present disclosure. The drawings in the present disclosure and their accompanying detailed disclosure are directed to merely exemplary implementations. However, the present disclosure is not limited to merely these exemplary implementations. Other variations and implementations of the present disclosure may be understood by those skilled in the art. Unless noted otherwise, like or corresponding elements among the figures may be indicated by like or corresponding reference numerals. Moreover, the drawings and illustrations in the present disclosure are generally not to scale and are not intended to correspond to actual relative dimensions.

For the purposes of consistency and ease of understanding, like features are identified (although, in some examples, not shown) by numerals in the exemplary figures. However, the features in different implementations may be different in other respects, and thus shall not be narrowly confined to what is shown in the figures.

The disclosure uses the phrases "in one implementation," "in some implementations," and so on, which may each refer to one or more of the same or different implementations. The term "coupled" is defined as connected, directly or indirectly through intervening components and is not necessarily limited to physical connections. The term "comprising" means "including, but not necessarily limited to," which specifically indicates open-ended inclusion or membership in the so-described combination, group, series and the equivalent.

Additionally, for the purposes of explanation and non-limitation, specific details, such as functional entities, techniques, protocols, standard, and the like, are set forth for providing an understanding of the described technology. In other examples, detailed disclosure of well-known methods, technologies, systems, architectures, and the like are omitted so as not to obscure the disclosure with unnecessary details.

The terms "first", "second", "third" and the like in the specification and the above-mentioned drawings of the present disclosure are used to distinguish between different objects rather than to describe a specific order. Additionally, the term "comprising" and its variations are intended to encompass non-exclusive inclusion. For example, processes, methods, systems, products, or devices that encompass a series of steps or modules are not limited to the steps or modules listed, but may optionally include steps or modules not listed, or optionally include other inherent steps or modules for those processes, methods, products, or devices.

The present disclosure will be described in further detail with reference to the attached drawings.

Figure 2:
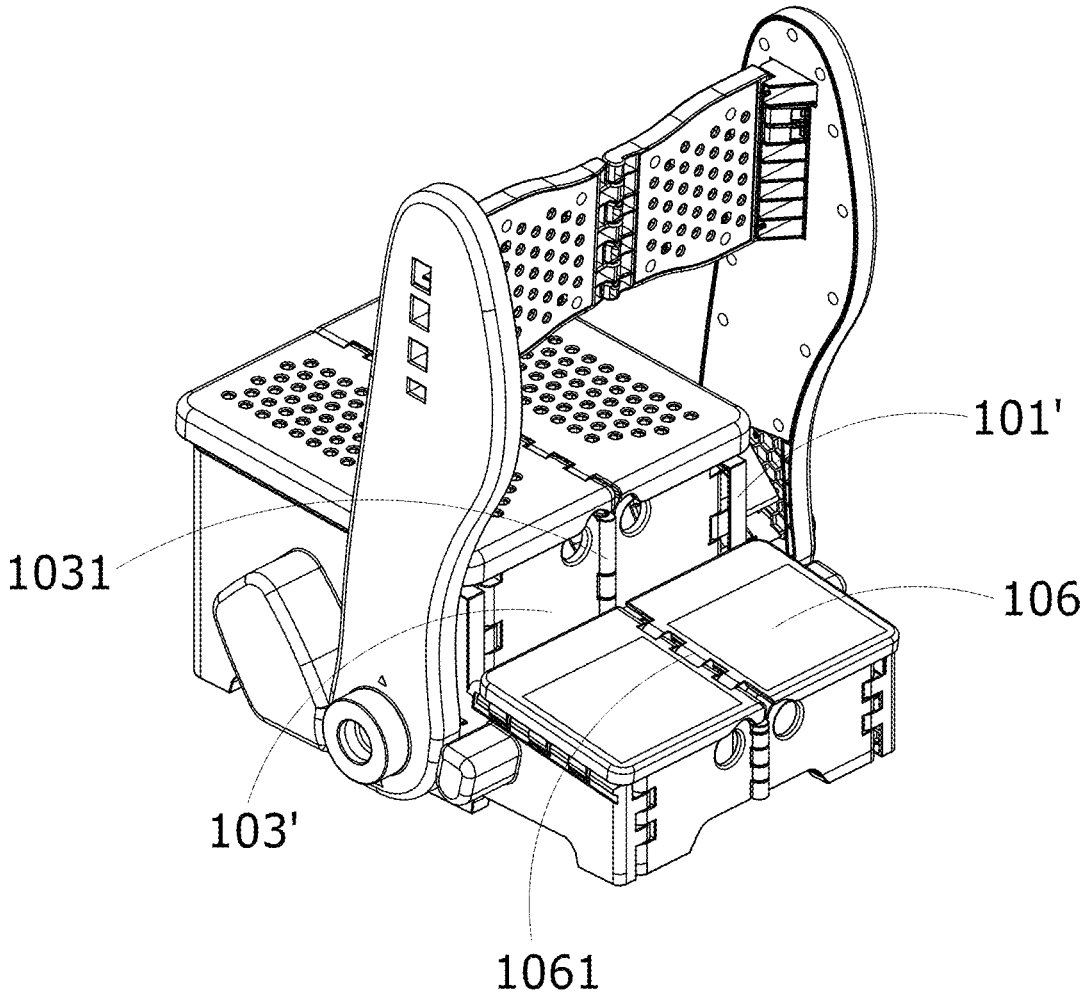
FIG. 2 illustrates another perspective view of the multi-purpose folding chair according to an example implementation of the present disclosure.

Please refer to FIG. 1 and FIG. 2. The multi-purpose folding chair 10 shown in the FIG. 1 and FIG. 2 include two supporting side plates (101, 101'), two armrest plates (102, 102'), two connecting plates (103, 103'), a seat plate 104, a back plate 105, and a kneeling plate 106. The two supporting side plates (101, 101') are arranged correspond to each other, and the two armrest plates (102, 102') are pivotally connected to the two supporting side plates (101, 101'). Each of the two connecting plates (103, 103') has a first folding line 1031 and the two connecting plates are positioned between the two supporting side plates (101, 101') as well as pivotally connected to the two supporting side plates (101, 101'). The two connecting plates (103, 103') are foldable in a flat manner through the first folding line 1031. The seat plate 104 has a second folding line 1041 and the seat plate 104 is positioned between the two supporting side plates (101, 101') as well as pivotally connected to the two supporting side plates (101, 101'). Two sides of the seat plate 104 are pivotally connected to the two supporting side plates (101, 101') and are foldable in a flat manner through the second folding line 1041. Additionally, the kneeling plate 106 has a third folding line 1061 and the kneeling plate 106 is positioned between the two supporting side plates (101, 101'). Two sides of the kneeling plate 106 are pivotally connected to the two supporting side plates (101, 101'). Furthermore, the back plate 105 has a fourth folding line 1051 and the back plate 105 is positioned between the two armrest plates (102, 102'). Two sides of the back plate 105 are pivotally connected to the two armrest plates (102, 102'). The back plate 105 is foldable in a flat manner through the fourth folding line 1051. Each of the connecting plates (103, 103') is foldable in a flat manner along the corresponding first folding line 1031, the seat plate 104 is foldable in a flat manner along the second folding line 1041, the kneeling plate 106 is foldable in a flat manner along the third folding line 1061, and the back plate 105 is foldable in a flat manner along the fourth folding line 1051, thus reducing a distance between the two supporting side plates (101, 101').

Figure 7:
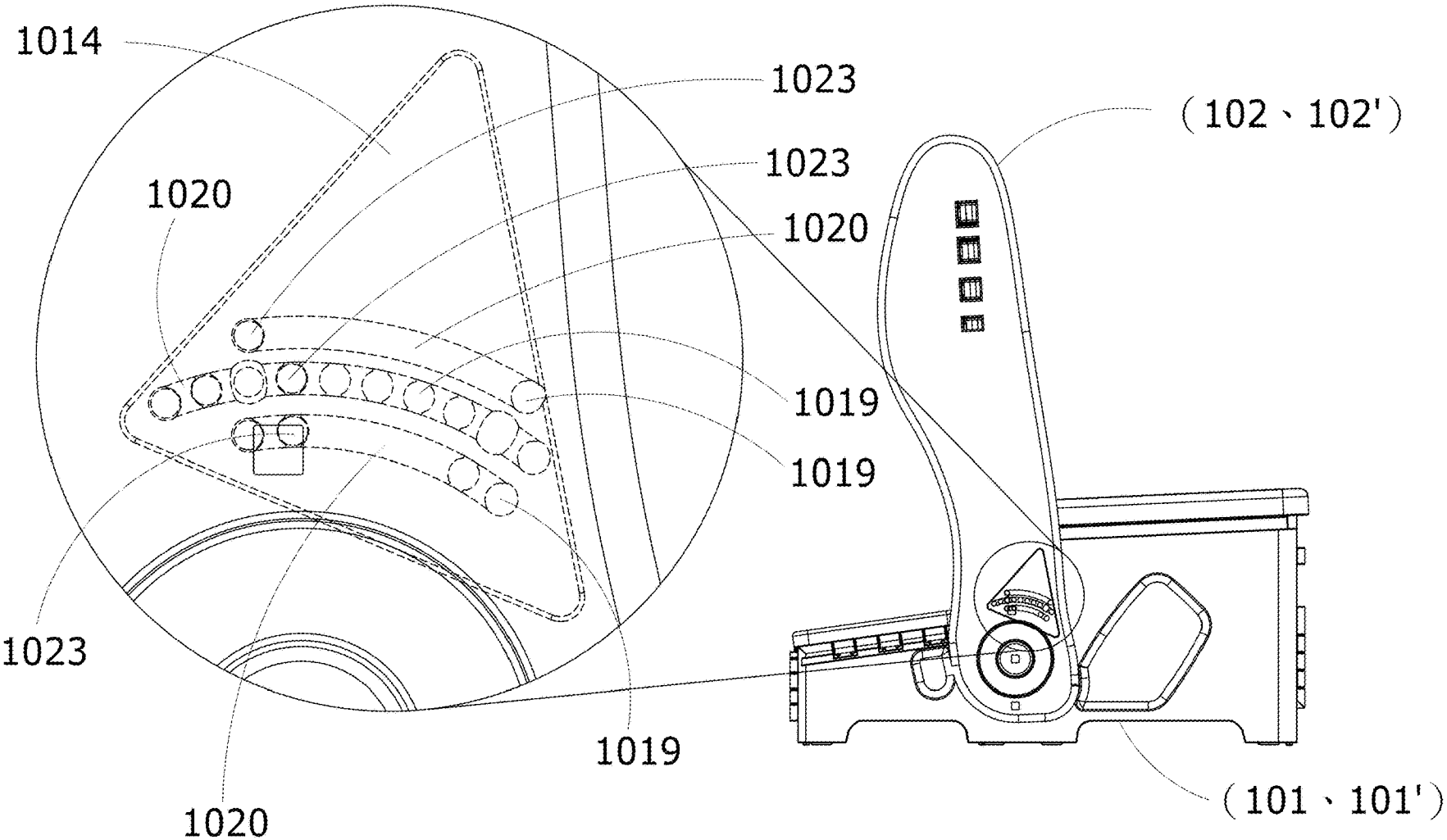
FIG. 7 illustrates a schematic diagram of an operation of a limiting part and a corresponding limiting part according to an example implementation of the present disclosure.

Please refer to FIG. 3 to FIG. 6. The multi-purpose folding chair 10 includes two supporting side plates (101, 101'), two armrest plates (102, 102'), two connecting plates (103, 103'), a seat plate 104, a back plate 105, and a kneeling plate 106. The supporting side plate 101 has a first rotating part 1011, and the top portion of the first rotating part 1011 is formed with a first supporting part 1015 and a second supporting part 1016. The first supporting part 1015 is formed with at least one first supporting part pivot element 10151, and the second supporting part 1016 is formed with at least one second supporting part pivot element 10161. There is a distance drop between the first supporting part 1015 and the second supporting part 1016. Furthermore, the inner side surface of the supporting side plate 101 is sequentially formed from the outer side to the inner side with at least one first pivot element 1017 and at least one second pivot element 1018. The inner side of the supporting side plate 101 is formed with a reinforcement structure 107. The armrest plate 102 is formed with a second rotating part 1021 at one end and a supporting part 1022 at another end. The inner side of the armrest plate 102 is formed with the reinforcement structure 107. The armrest plate 102 may pivotally connect to the first rotating part 1011 of the supporting side plate 101 through the second rotating part 1021, allowing the armrest plate 102 to rotate relative to the supporting side plate 101. The inner side of the armrest plate 102 is formed with at least one back plate corresponding pivot element 1024. In one implementation, the supporting side plate 101 is formed with a first top supporting part 1012 and a second top supporting part 1013. The first rotating part 1011 is formed between the first top supporting part 1012 and the second top supporting part 1013. Each of the first top supporting part 1012 and a second top supporting part 1013 may restrict the rotation angle of the armrest plate 102, where the armrest plate 102 is pivotally connected to the first rotating part 1011, allowing the armrest plate 102 to rotate within a defined angle range between the first top supporting part 1012 and the second top supporting part 1013. In one implementation, the inner side of the armrest plate 102 is formed with at least one limiting part 1023, where the limiting part 1023 may be a protruding column. A corresponding limiting part 1014 is formed on the supporting side plate 101 that corresponds to the limiting part 1023. The corresponding limiting part 1014 may be a raised platform. The surface of the raised platform is formed with at least one curved track 1020 (as shown in FIG. 7). The structure of the supporting side plate 101 is the same as that of the supporting side plate 101', and the structure of the armrest plate 102 is the same as the armrest plate 102'. In one implementation, the inner side of both armrest plates (102, 102') is covered with a reinforcing cover plate 1026, which reinforces the overall structural strength of both armrest plates (102, 102'). In one implementation, the first rotating part 1011 of the supporting side plate 101 is formed as a pivot axis, and the second rotating part 1021 of the armrest plate 102 is formed as a pivot hole. In one implementation, the armrest plate 102 may pivotally connect to the first rotating part 1011 of the supporting side plate 101 through the second rotating part 1021, allowing the armrest plate 102 to rotate relative to the supporting side plate 101.

In one implementation, the two sides of each of the two connecting plates (103, 103') are formed with at least one connecting plate pivot element (1032, 1032'). The connecting plate pivot elements (1032, 1032') of the two connecting plates (103, 103') may respectively and pivotally connect to the first pivot elements (1017, 1017') and the second pivot elements (1018, 1018') of the two supporting side plates (101, 101'). One of the connecting plates (103, 103') is formed with at least one kneeling plate top supporting element 1039. In one implementation, each of the connecting plates (103, 103') includes a first plate 1033 and a second plate 1034. One side of the first plate 1033 is formed with at least one plate pivot element 1035, and one side of the second plate 1034 corresponding to the plate pivot element 1035 is formed with a plate corresponding pivot element 1036. The first plate 1033 may pivotally connect to the plate corresponding pivot element 1036 of the second plate 1034 through the plate pivot element 1035, allowing the first plate 1033 to fold flat relative to the second plate 1034. The connecting plate pivot elements (1032, 1032') of one connecting plate (103) correspond to the first pivot elements (1017, 1017') and the connecting plate pivot elements (1032, 1032') of the other connecting plate (103') correspond to the second pivot elements (1018, 1018'). The first plate 1033 and the second plate 1034 of one connecting plate (103) may pivotally connect to the first pivot elements (1017, 1017') through the connecting plate pivot elements (1032, 1032') of one connecting plate (103), and the first plate 1033 and the second plate 1034 of the other connecting plate (103') may pivotally connect to the second pivot elements (1018, 1018') through the connecting plate pivot elements (1032, 1032') of the other connecting plate (103'). The inner side surfaces of each of the first plate 1033 and the second plate 1034 are formed with the reinforcement structure 107.

In one implementation, the inner side of the seat plate 104 is formed with the reinforcement structure 107. Two sides of the seat plate 104 are formed with at least one seat plate pivot element 1042 correspond to the first supporting parts (1015, 1015'). The seat plate pivot elements 1042 on both sides of the seat plate 104 may pivotally connect to the first supporting part pivot element (10151, 10151') of the first supporting parts (1015, 1015'), allowing the seat plate 104 to be positioned between the two first supporting parts (1015, 1015'). In one implementation, the seat plate 104 includes a first supporting plate 1043 and a second supporting plate 1044. The inner sides of each of the first supporting plate 1043 and the second supporting plate 1044 are formed with the reinforcement structure 107. One side of the first supporting plate 1043 is formed with at least one supporting plate pivot element 1045, and one side of the second supporting plate 1044 corresponding to the supporting plate pivot element 1045 is formed with at least one supporting plate corresponding pivot element 1046. The first supporting plate 1043 may pivotally connect to the supporting plate corresponding pivot element 1046 through the supporting plate pivot element 1045, allowing the first supporting plate 1043 to bend and fold flat relative to the second supporting plate 1044. The sides of each of the first supporting plate 1043 and the second supporting plate 1044 facing the first supporting parts (1015, 1015') form the seat plate pivot elements 1042. The first supporting plate 1043 and the second supporting plate 1044 may pivotally connect to the first supporting part pivot elements 10151 of the first supporting parts (1015, 1015') through the seat plate pivot elements 1042. Furthermore, in one implementation, each of the first supporting plate 1043 and the second supporting plate 1044 is formed with a handle hole 1047.

In one implementation, the inner side of the back plate 105 is formed with the reinforcement structure 107. Two sides of the back plate 105 is formed with at least one back plate pivot element 1052 correspond to the two armrest plates (102, 102'). The two sides of the back plate 105 may pivotally connect to the back plate corresponding pivot elements (1024, 1024') of the two armrest plates (102, 102') through the back plate pivot elements 1052, allowing the back plate 105 to be positioned between the two armrest plates (102, 102'). In one implementation, the back plate 105 includes a first bearing plate 1053 and a second bearing plate 1054. The inner sides of each of the first bearing plate 1053 and the second bearing plate 1054 are formed with the reinforcement structure 107. One side of the first bearing plate 1053 is formed with at least one bearing plate pivot element 1055, and one side of the second bearing plate 1054 facing the bearing plate pivot element 1055 is formed with at least one bearing plate corresponding pivot element 1056. The first bearing plate 1053 may pivotally connect to the bearing plate corresponding pivot element 1056 through the bearing plate pivot element 1055, allowing the first bearing plate 1053 to bend and fold flat correspond to the second bearing plate 1054. The sides of each of the first bearing plate 1053 and the second bearing plate 1054 facing the two armrest plates (102, 102') form the back plate pivot elements 1052. The first bearing plate 1053 and the second bearing plate 1054 may pivotally connect to the back plate corresponding pivot elements (1024, 1024') of the armrest plates (102, 102') through the back plate pivot elements 1052, allowing each of the first bearing plate 1053 and the second bearing plate 1054 to movably pivot toward the two back plate corresponding pivot elements (1024, 1024'). Furthermore, in one implementation, the inner side of the back plate 105 is covered with a reinforcing cover plate 1057 to increase the overall structural strength of the back plate 105.

In one implementation, the inner side of the kneeling plate 106 is formed with the reinforcement structure 107. Two sides of the kneeling plate 106 are formed with at least one kneeling plate pivot element 1062 that corresponds to the second supporting parts (1016, 1016'). The kneeling plate pivot elements 1062 of the kneeling plate 106 may pivotally connect to the second supporting part pivot elements (10161, 10161') of the two second supporting parts (1016, 1016'), allowing the kneeling plate 106 to be positioned between the two second supporting parts (1016, 1016') of the two supporting side plates (101, 101'), and the side of the kneeling plate 106 facing the connecting plate 103' may press against the kneeling plate top supporting element 1039. In one implementation, the kneeling plate 106 includes a first kneeling plate 1063 and a second kneeling plate 1064. One side of the first kneeling plate 1063 is formed with at least one kneeling plate pivot element 1065, and one side of the second kneeling plate 1064 facing the kneeling plate pivot element 1065 is formed with at least one kneeling plate corresponding pivot element 1066. The first kneeling plate 1063 may pivotally connect to the kneeling plate corresponding pivot element 1066 through the kneeling plate pivot element 1065, allowing the first kneeling plate 1063 to bend and fold flat relative to the second kneeling plate 1064. The side of each of the first kneeling plat 1063 and the second kneeling plate 1064 facing the two second supporting parts (1016, 1016') forms the kneeling plate pivot element 1062. The first kneeling plate 1063 and the second kneeling plate 1064 may pivotally connect to the second supporting part pivot elements (10161, 10161') of the second supporting parts (1016, 1016') through the kneeling plate pivot elements 1062, and allowing the first kneeling plate 1063 and the second kneeling plate 1064 to pivotally connect to the second supporting part pivot, elements (10161, 10161'). In one implementation, a kneeling plate reinforcement, plate 109 is pivotally connected between the two supporting side plates (101, 101') to provide additional support for one side of the kneeling plate 106 and increase the supporting force for supporting the kneeling plate 106. The kneeling plate reinforcement plate 109 may also be formed with a fifth folding line 1091, the kneeling plate reinforcement plate 109 is foldable in a flat manner through the fifth folding line 1091. The combination of the above components is illustrated in FIG. 1 and FIG. 2.

Figure 3:
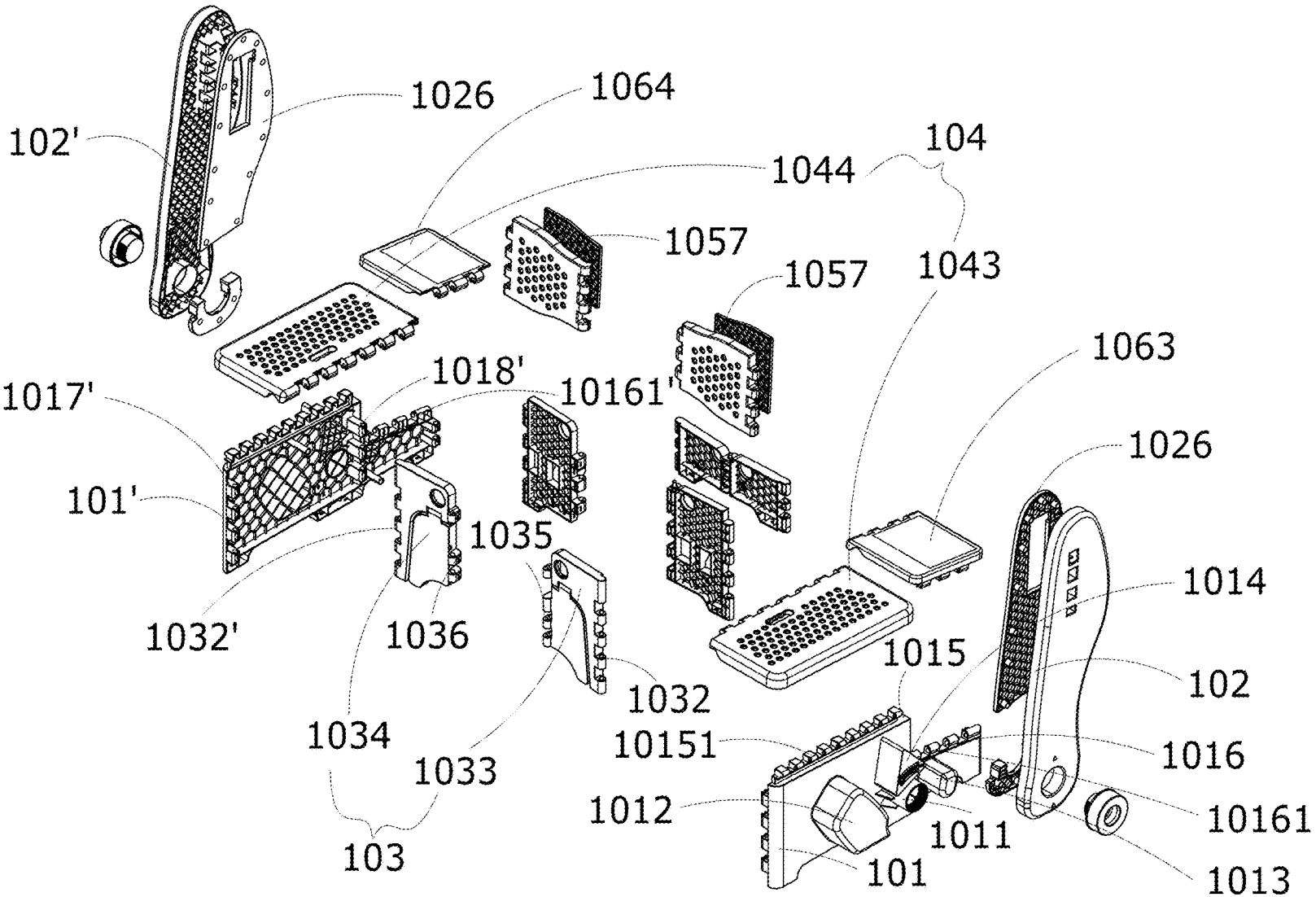
FIG. 3 illustrates an exploded view of the multi-purpose folding chair according to another example implementation of the present disclosure.
Figure 4:
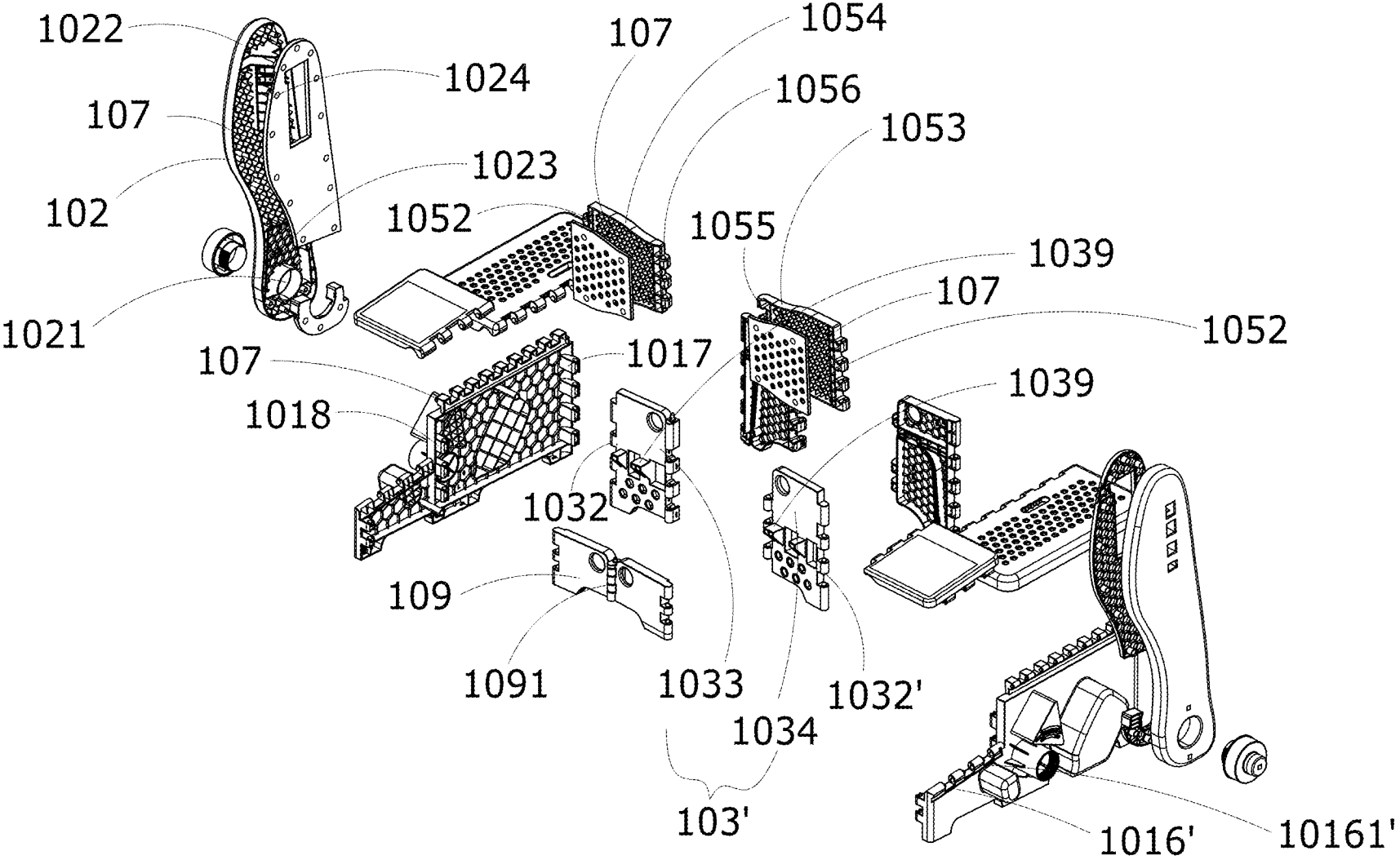
FIG. 4 illustrates another exploded view of the multi-purpose folding chair according to an example implementation of the present disclosure.
Figure 5:
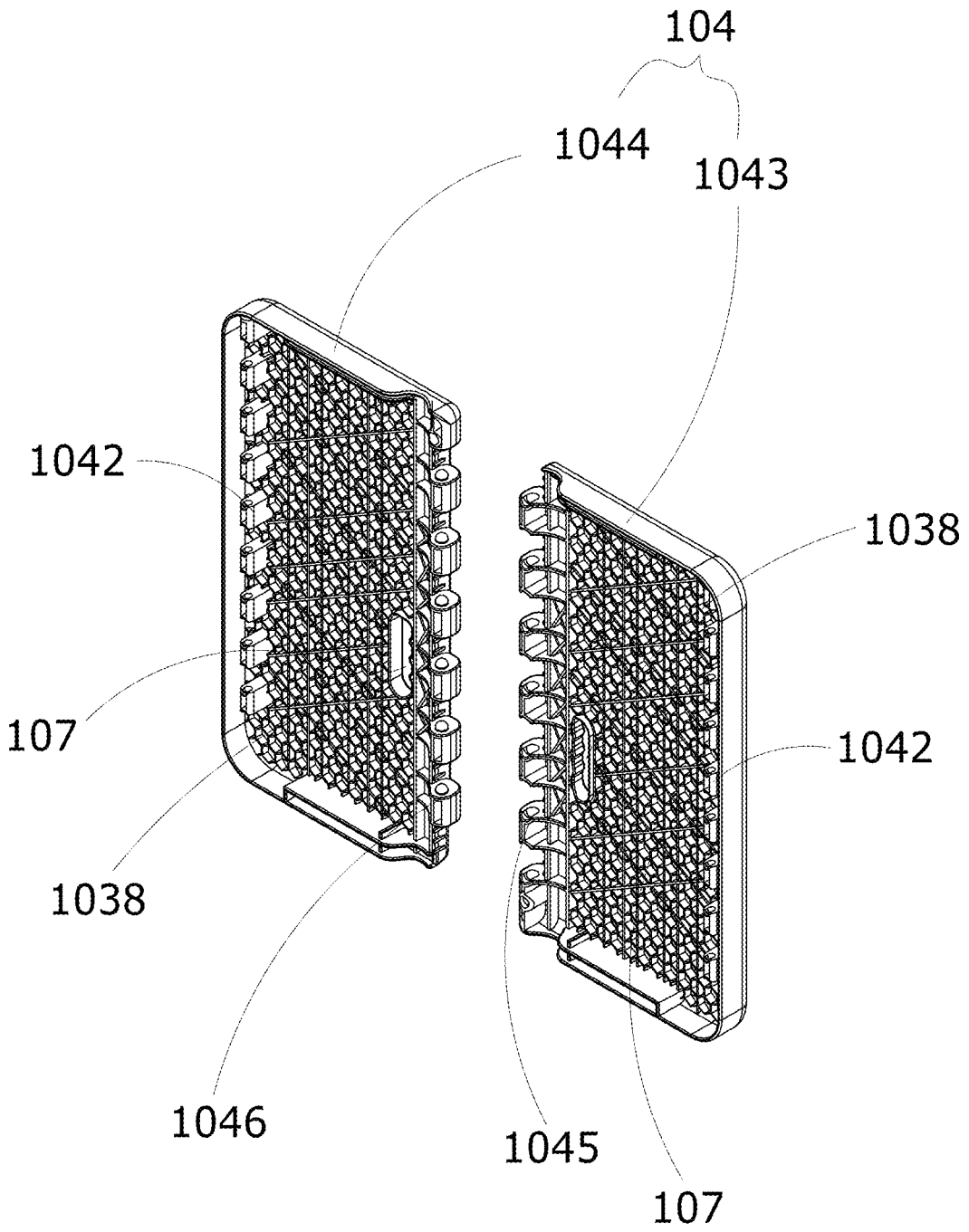
FIG. 5 illustrates an exploded view of a seat plate according to an example implementation of the present disclosure.
Figure 6:
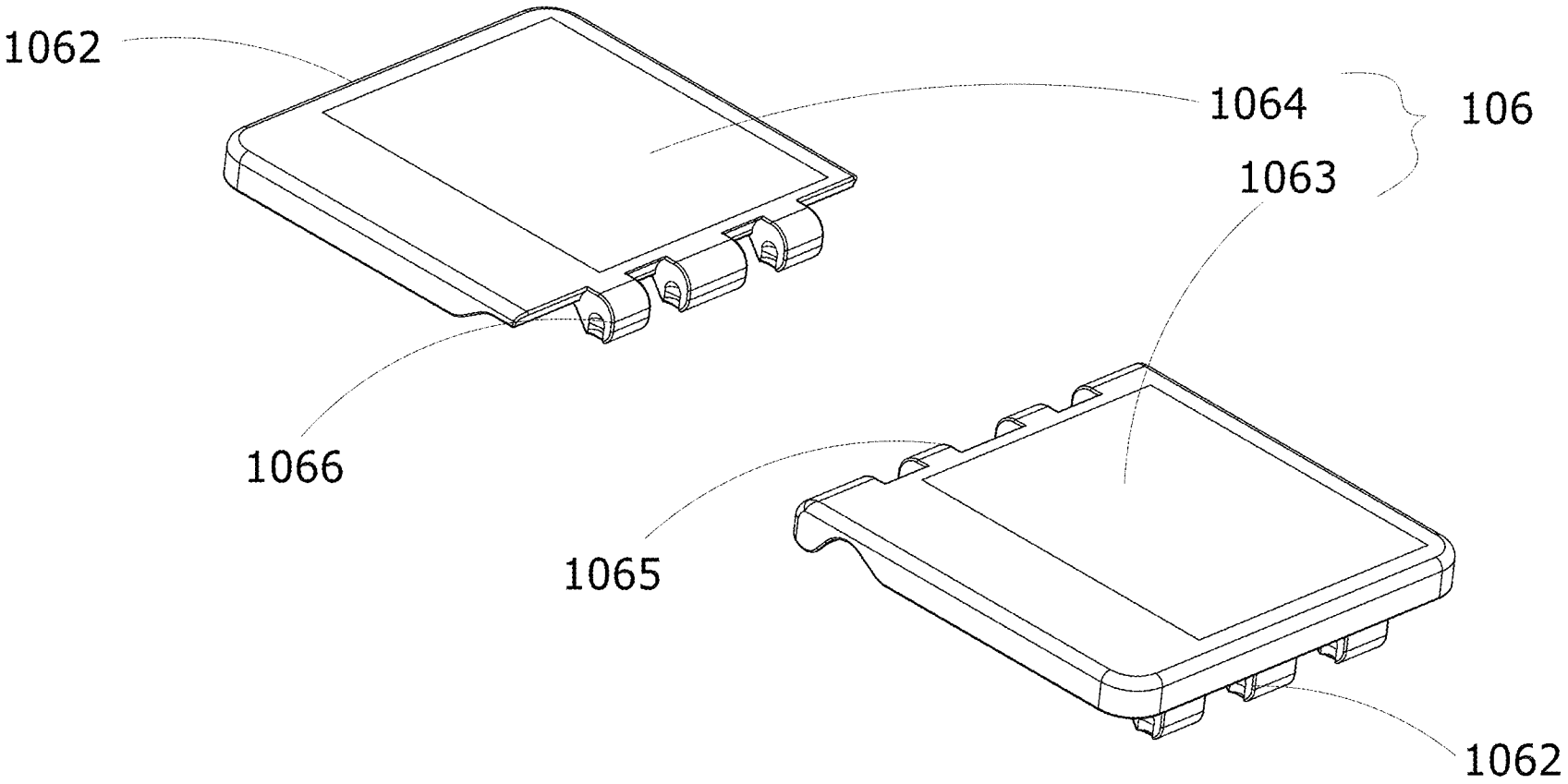
FIG. 6 illustrates an exploded view of a kneeling plate according to an example implementation of the present disclosure.
Figure 8:
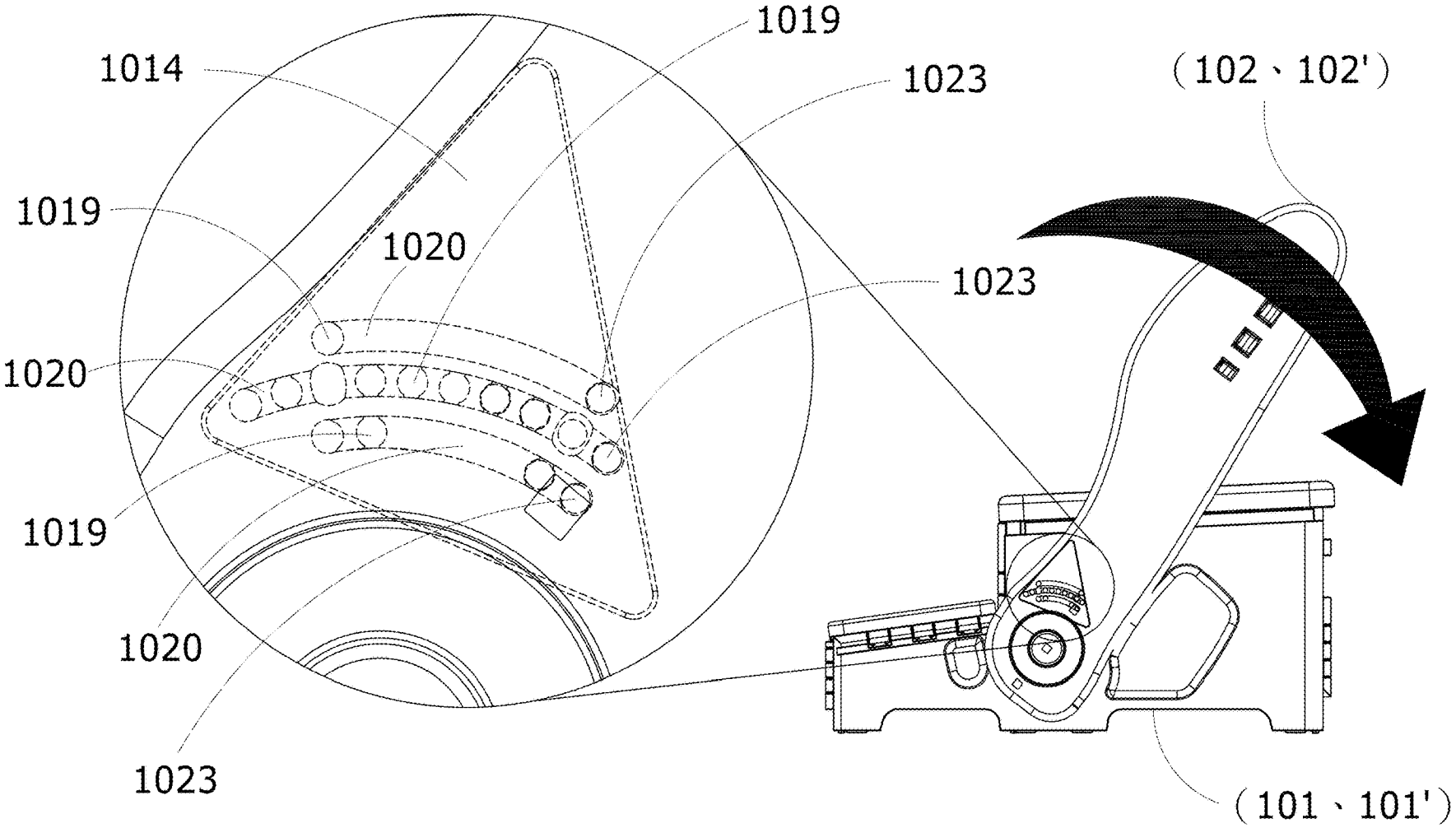
FIG. 8 illustrates another schematic diagram of the operation of the limiting part and the corresponding limiting part according to an example implementation of the present, disclosure.

Please refer to FIG. 7 and FIG. 8 with FIG. 3 and FIG. 4. In some implementations, the limiting part 1023 may be in the form of protruding columns, while the corresponding limiting part 1014 is formed with multiple curved tracks 1020. In one implementation, there are three curved tracks 1020, each of the curved tracks is in concave shape. The quantity of the limiting part 1023 is more than one and the limiting parts 1023 are positioned corresponding to the curved tracks 1020. Therefore, when the limiting parts 1023 are coupled to the curved tracks 1020, the limiting parts 1023 may slide relative to the curved tracks 102 of the corresponding limiting part 1014. The armrest plate 102 may rotate counterclockwise or clockwise corresponding to the supporting side plate 101 after being pushed. The configuration of the two armrest plates (102, 102') rotating correspondingly to the two supporting side plates (101, 101') is shown in FIG. 7 and FIG. 8. In one implementation, each curved track 1020 is formed with at least one limiting hole 1019. When the limiting parts 1023 slide correspondingly to the curved tracks 1020, the protruding columns of each of the limiting parts 1023 may clamped into the limiting holes 1019, after sliding, to provide a limiting effect. When the two armrest plates (102, 102') rotate correspondingly to the two supporting side plates (101, 101'), a sliding segment difference effect is further generated. Additionally, in one implementation, the protruding columns of the limiting parts 1023 are formed in a spherical shape, such that the limiting part 1023 may be easily separated from the limiting hole 1019.

Figure 9:
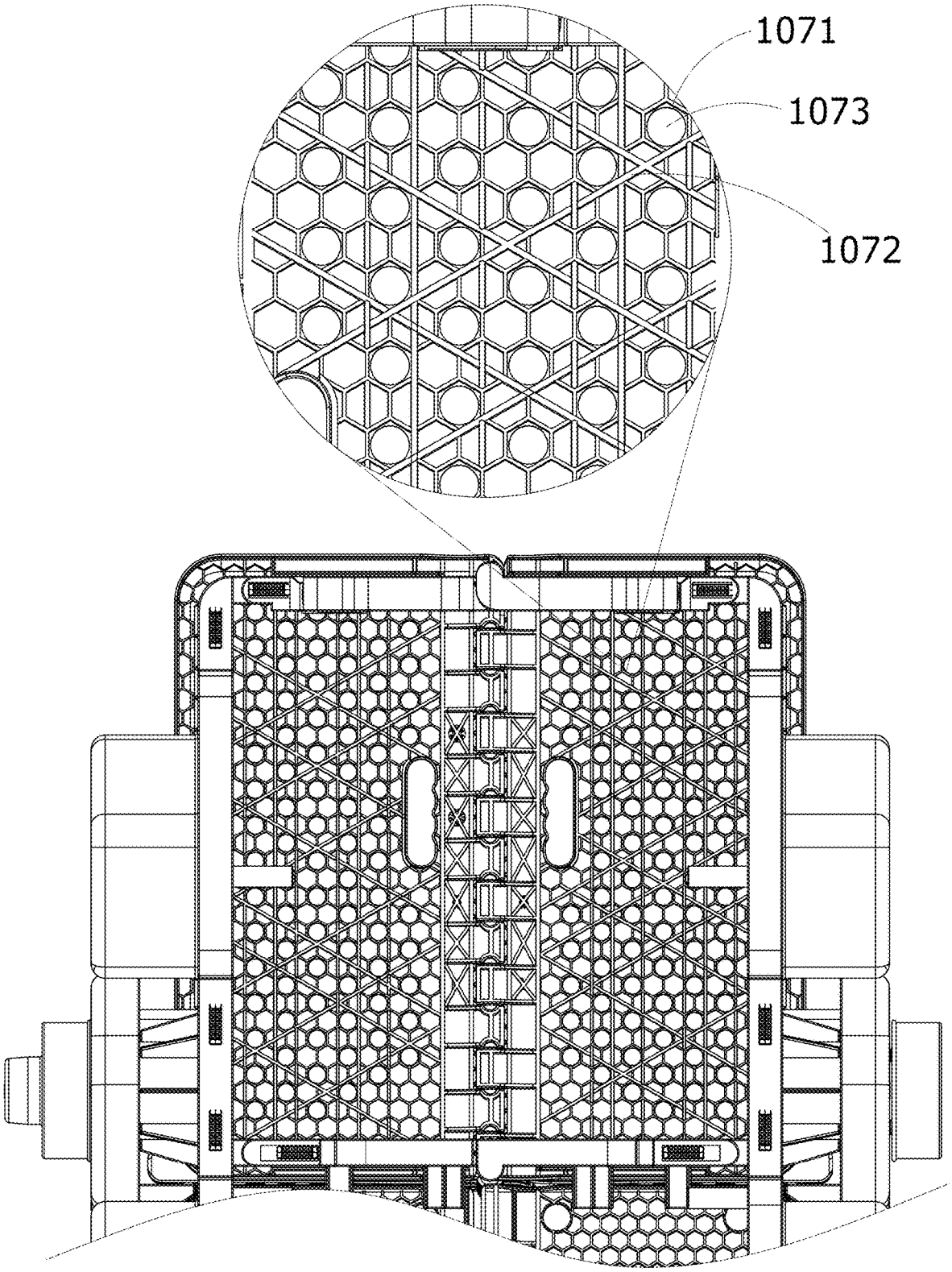
FIG. 9 illustrates a schematic diagram of a reinforcement structure according to an example implementation of the present disclosure.

Please refer to FIG. 9. In one implementation, the reinforcement structure 107 further includes a plurality of hexagonal reinforcement lattices 1071 and a plurality of reinforcing ribs 1072. The plurality of hexagonal reinforcement lattices 1071 are arranged in a honeycomb shape, and each of the plurality of reinforcing ribs 1072 intersects some of the hexagonal reinforcement lattices 1071 which are connected. Each of reinforcing ribs 1072 may intersect the hexagonal reinforcement lattices 1071 in various directions, such as vertical, horizontal, or diagonal. Some portions of the hexagonal reinforcement lattices 1071 are formed with perforations 1073. It should be noted that this illustration is provided as an implementation and does not limit the connecting pattern of the reinforcing ribs 1072.

Figure 10:
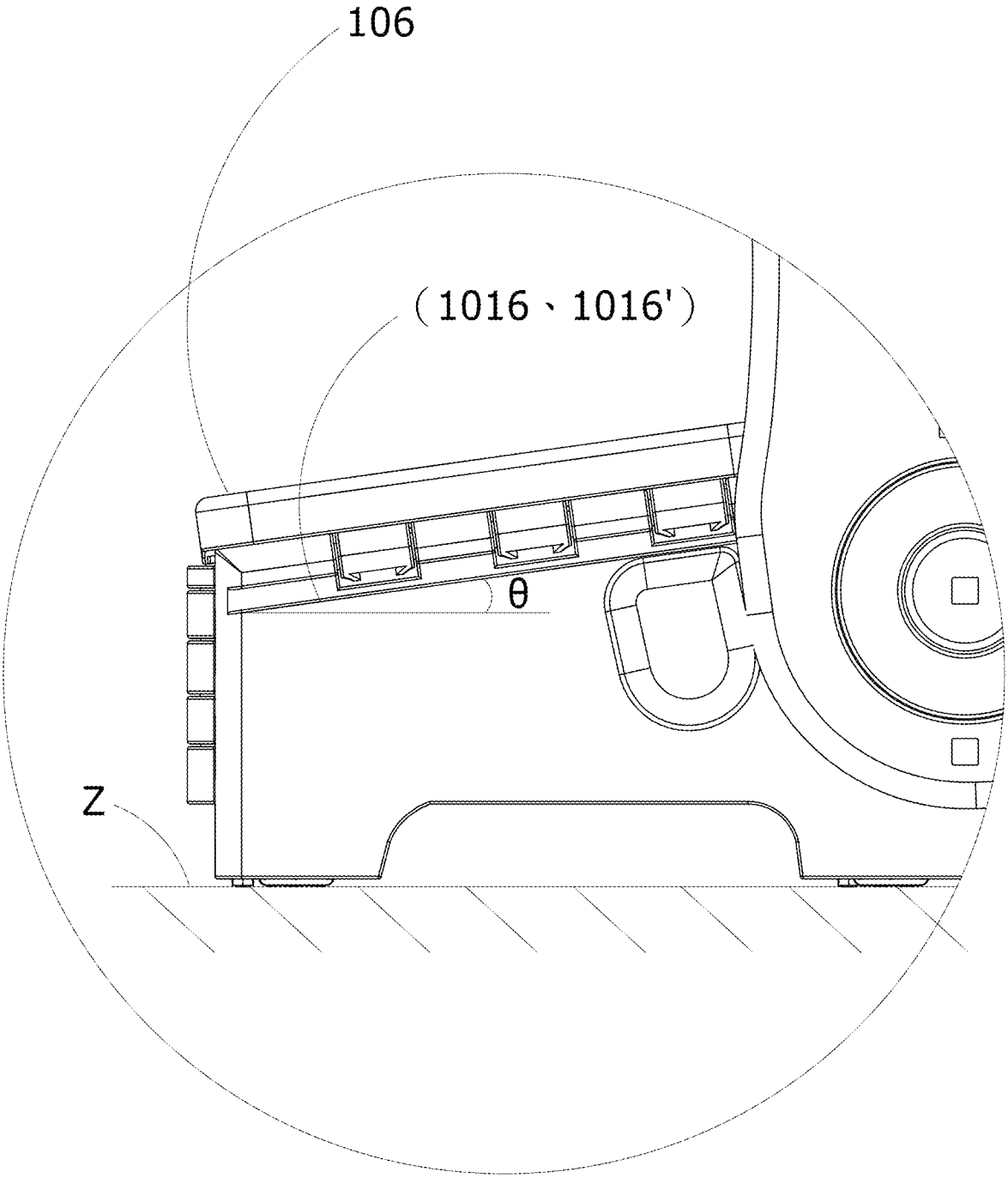
FIG. 10 illustrates an angle diagram of the kneeling plate according to an example implementation of the present disclosure.
Figure 11:
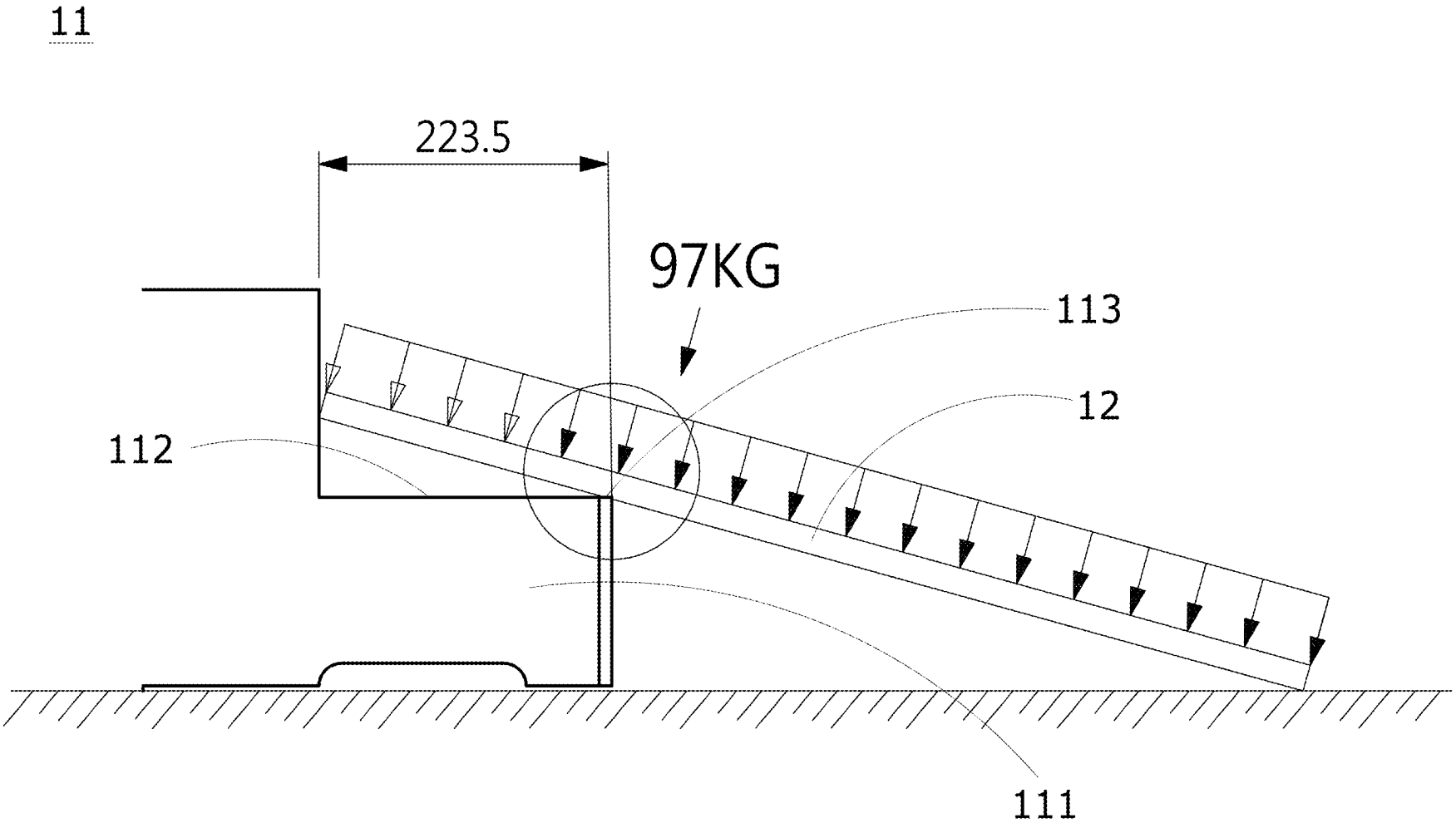
FIG. 11 illustrates a schematic diagram of a conventional kneeling position under stress.
Figure 12:
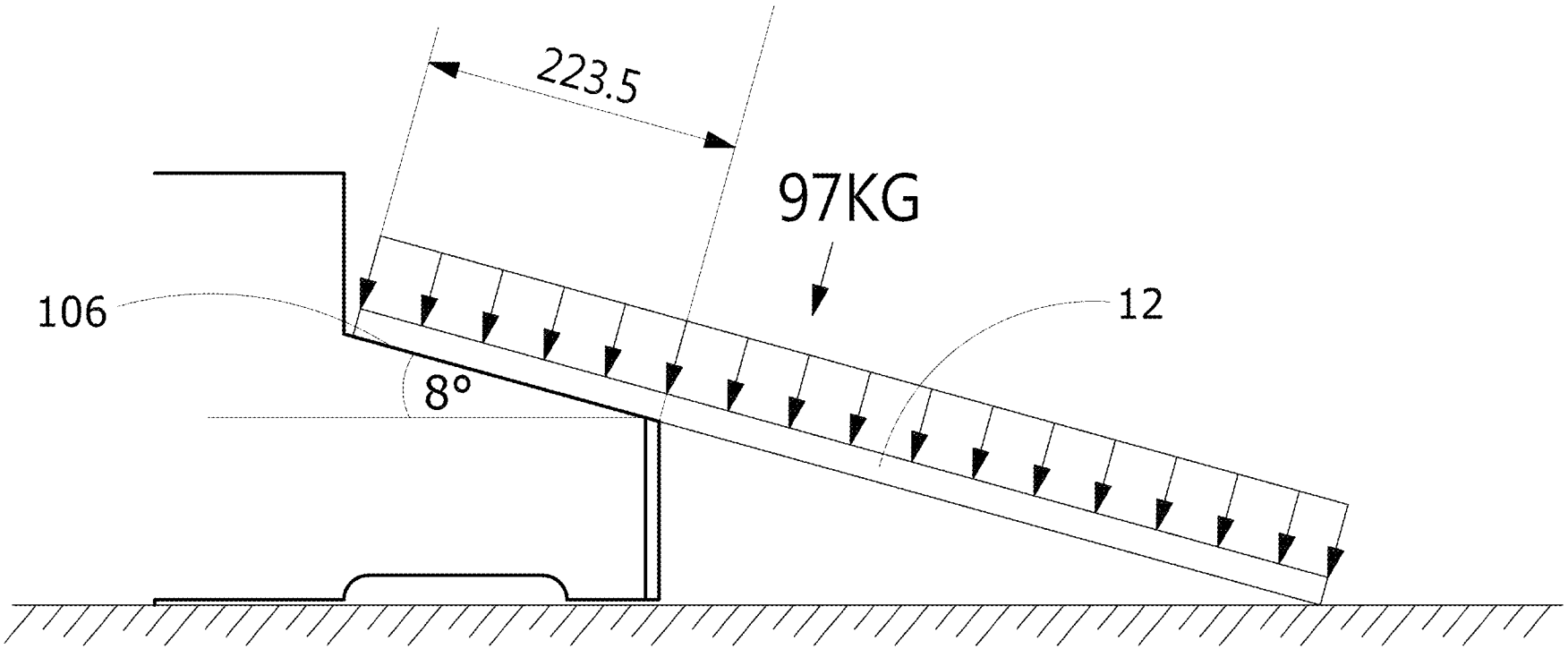
FIG. 12 illustrates a schematic diagram of stress distribution on the kneeling plate according to an example implementation of the present disclosure.

Please refer to FIG. 10. In one implementation, each of the two second supporting parts (1016, 1016') have an inclination θ relative to a ground Z. The preferred angle for the inclination θ is 8 degrees, and the inclinations θ of the two second supporting parts (1016, 1016') are the same. When the kneeling plate 106 is pivotally connected to the two second supporting parts (1016, 1016'), the plane of the kneeling plate 106 will form an inclined plane that matches the inclinations of the two second supporting parts (1016, 1016'). As a result, when a user performs a kneeling action, the kneeling plate 106, which forms the inclined plane, provides a more comfortable support for the user's knees. Please also refer to FIGS. 11 and 12. FIG. 11 shows a "chair" as disclosed in Taiwan Patent Publication No. 517965. In FIG. 11, a side view of the chair seat has a double-layered configuration, a lower seat part 111 with a plane of 180 degrees is connected behind the seat 11. The seating surface of the lower seat part 111 includes a soft rectangular cushion 112. FIG. 12 illustrates the configuration of the inclined kneeling plate 106 of the present disclosure at an angle of 8 degrees. The stress analysis of both the lower seat part 111 and the kneeling plate 106 is as follows:

$$\sigma=P/A$$

In other words, stress (σ)=force on the perpendicular surface (P)/cross-sectional area of the bearing force (A). Assuming that the force on the perpendicular surface is 97 kg×9.81 m/s$^2$=951.57 N.

Assuming the contact area at the corner 113 of the lower seat part 111 is 100 mm×1 mm, when a person kneels with their knees to the lower leg area (as indicated by label 12 in the FIG. 11), stress will concentrate at the corner 113 of the kneeling plate, resulting in excessive localized stress. The stress calculation for the corner 113 of the lower seat part is as follows:

$$\sigma 1=951.57N/(100\ \text{mm}\times 1\ \text{mm})=9.52N/\text{mm}^2\approx 9.52\ \text{MPa}$$

Assuming that the contact area of the kneeling plate 106 is 100 mm×223.5 mm, when a person kneels with their knees to the lower leg area (as indicated by label 12 in the FIG. 12), because the kneeling plate 106 is inclined, the stress will be evenly distributed on the kneeling plate 106. The stress calculation for the kneeling plate 106 is as follows:

$$\sigma 2=951.57N/(100\ \text{mm}\times 223.5\ \text{mm})=0.0426N/\text{mm}^2\approx 0.0426\ \text{MPa}$$

From the above, when a person's knees to lower leg area (as indicated by label 12 in the FIG. 11 and FIG. 12) kneel on the 180-degree plane of the lower seat part 111, the knees to lower leg area will experience a reverse stress of approximately 9.52 MPa. Conversely, when a person's knees to lower leg area kneel on the inclined kneeling plate 106 at an angle of 8 degrees, the knees to lower leg area will experience a reverse stress of approximately 0.0426 MPa. Due to the design of the kneeling plate 106 with an 8-degree inclination, the inclined surface of the kneeling plate 106 increases the cross-sectional area of the bearing force, resulting in a significant improvement in the reverse stress experienced by the knees to lower leg area during kneeling. This is because stress is inversely proportional to the cross-sectional area of the bearing force and directly proportional to the force on the perpendicular surface. In other words, the larger the cross-sectional area of the bearing force, the smaller the stress value. Therefore, the 8-degree inclination of the kneeling plate 106 greatly improves the comfort during kneeling.

Figure 13:
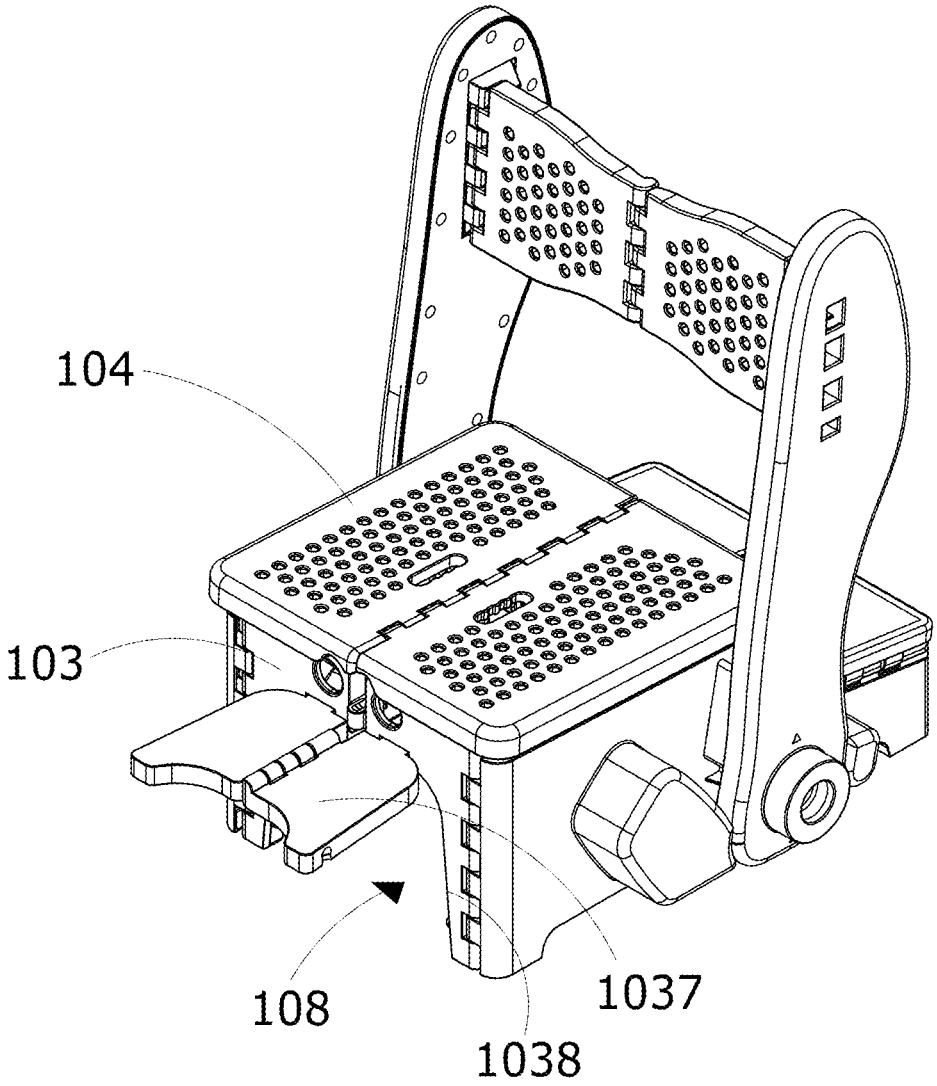
FIG. 13 is a schematic diagram illustrating the multi-purpose folding chair according to an example implementation of the present disclosure.

Please refer to FIG. 13. In one implementation, the connecting plate 103 further includes a shield plate 1037. The shield plate 1037 is pivotally connected to the first plate 1033 and the second plate 1034, allowing the shield plate 1037 to be lifted relative to the first plate 1033 and the second plate 1034. As shown in FIG. 13, when the shield plate 1037 is lifted, the connecting plate 103 forms an opening 1038. This opening 1038 is in communication with a storage space 108 formed at the bottom of the seat plate 104. Therefore, the user may lift the shield plate 1037 and place personal items, such as shoes, into the storage space 108, and then cover the shield plate 1037 to protect the privacy of the personal items.

Figure 14:
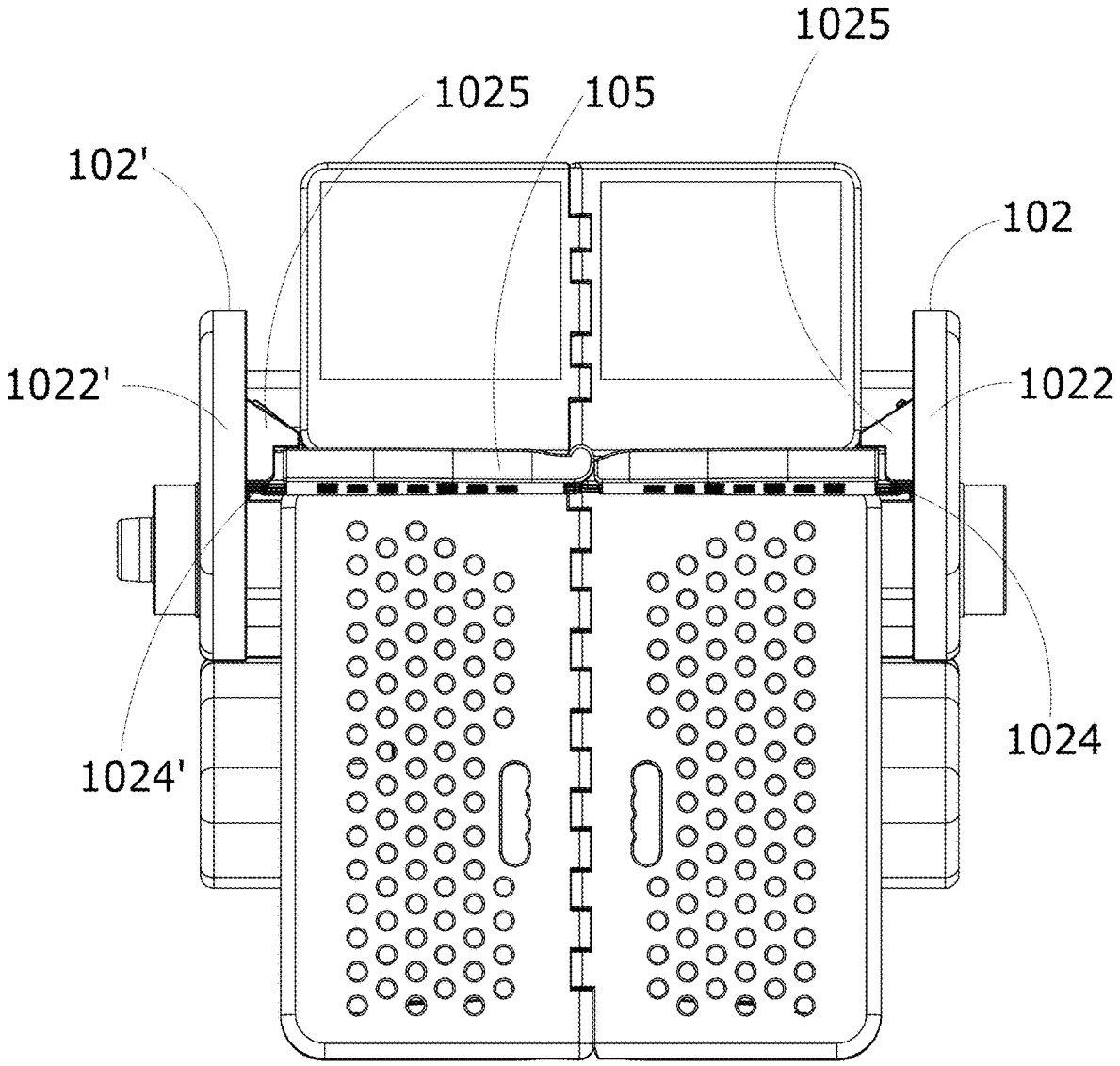
FIG. 14 is a top view illustrating the multiple-folding chair according to an example implementation of the present disclosure.

Please refer to FIG. 14. In one implementation, each of the supporting parts (1022, 1022') of the two armrest boards (102, 102') extend from the back plate corresponding pivot elements (1024, 1024') to form at least one leaning part 1025. When the two sides of the back plate 105 are pivotally connected to the back plate corresponding pivot elements (1024, 1024'), the leaning part 1025 may provide support for the back plate 105 that is movably and pivotally connect to one side of the supporting parts (1022, 1022'), thus increasing the supporting force of the back plate 105.

Figure 15:
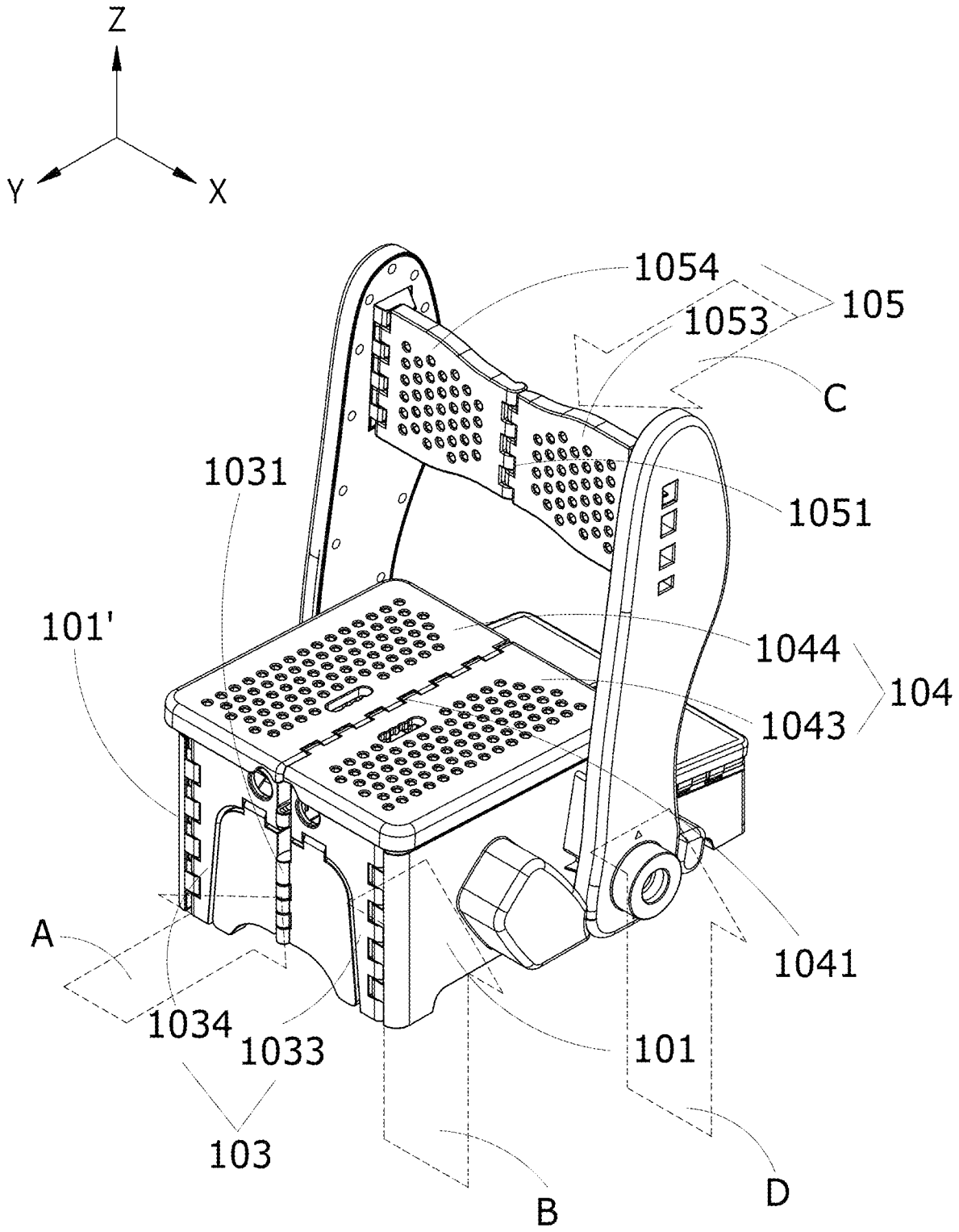
FIG. 15 is a schematic illustration illustrating a folding process of the multi-purpose folding chair according to an example implementation of the present disclosure.
Figure 16:
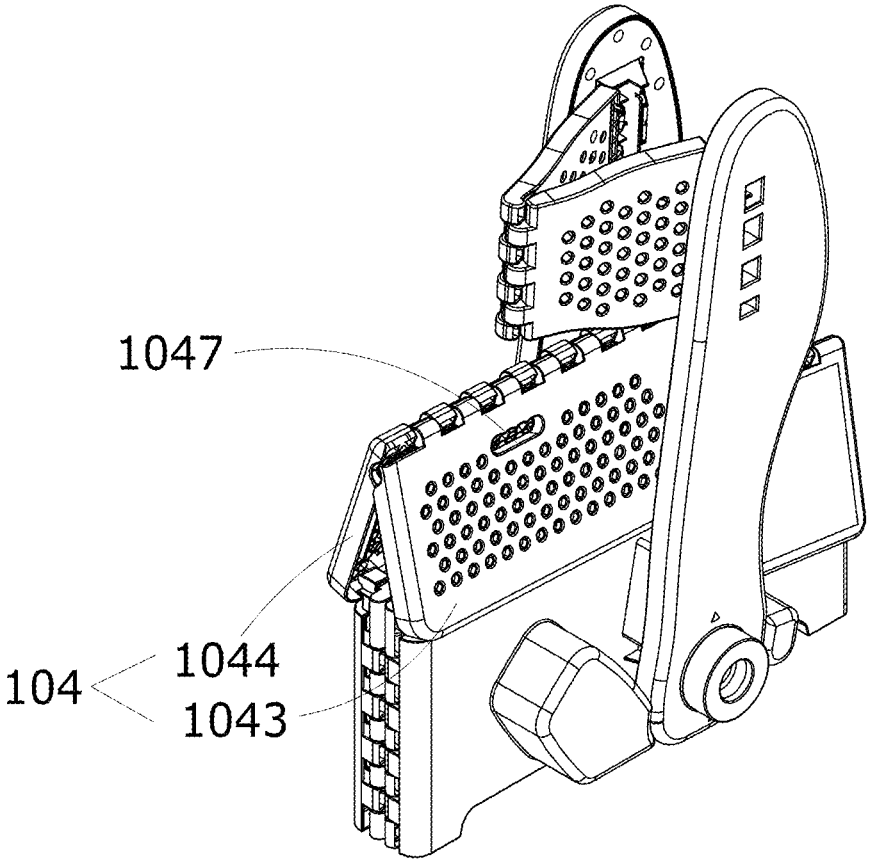
FIG. 16 is a schematic illustration further illustrating the folding process of the multi-purpose folding chair according to an example implementation of the present disclosure.

Please refer to FIG. 15 and FIG. 16 as well as FIG. 1 to FIG. 4 for better understanding. First, a coordinate system with three-dimensional directions is defined for illustration purposes. These three-dimensional directions are the X direction, Y direction, and Z direction, where these three directions are perpendicular to each other. The X direction and Y direction are defined to represent the longitudinal direction and the transverse direction on the same height plane, while the Z direction is the height direction. As shown in FIG. 13, the two supporting side plates (101, 101') are spaced apart and correspond to each other in the X direction. The pivot point of the first plate 1033 and the second plate 1034 of the two connecting plates (103, 103') is further defined as the first folding line 1031, which extends approximately in the Z direction. Accordingly, the first plate 1033 and the second plate 1034 pivot relative to each other through the first folding line 1031, such that the first plate 1033 and the second plate 1034 may be bent and foldable in a flat manner, allowing the connecting plates (103, 103') to change from a flat plate shape to a folded shape. The first supporting plate 1043 and the second supporting plate 1044 are pivotally connected to form the seat plate 104. The pivot point of the first supporting plate 1043 and the second supporting plate 1044 is defined by the second folding line 1041. The second folding line 1041 extends approximately in the Y direction. Accordingly, the first supporting plate 1043 and the second supporting plate 1044 pivot relative to each other through the second folding line 1041, such that the seat plate 104 may be bent and folded flat, allowing the seat plate 104 to change from a flat plate shape to a folded shape. The first bearing plate 1053 and the second bearing plate 1054 are pivotally connected to form the back plate 105. The pivot point of the first bearing plate 1053 and the second bearing plate 1054 is defined by the fourth folding line 1051, the fourth folding line 1051 extends approximately in the Z direction. Accordingly, the first bearing plate 1053 and the second bearing plate 1054 pivot relative to each other through the fourth folding line 1051, the back plate 105 may be bent and folded flat, allowing the back plate 105 to change from a flat plate shape to a folded shape. Furthermore, the first kneeling plate 1063 and the second kneeling plate 1064 are pivotally connected to form the kneeling plate 106. The pivot point of the first kneeling plate 1063 and the second kneeling plate 1064 is defined by the third folding line 1061, the third folding line 1061 extends approximately in the Y direction. Accordingly, the first kneeling plate 1063 and the second kneeling plate 1064 are pivot relative to each other through the third fold line 1061, such that the kneeling plate 106 may be bent and folded flat, allowing the kneeling plate 106 to change from a flat plate shape to a folded shape.

Furthermore, in the folding process of the multi-purpose folding chair 10 of the present disclosure, a slight force is required to bend each component. The folding process is as follows. A force may be applied to the two connecting plates (103, 103') to fold the first plate 1033 and the second plate 1034 along the first folding line 1031 (as indicated by arrow A in the FIG. 15). A force may also be applied to the seat plate 104 to fold the first supporting plate 1043 and the second supporting plate 1044 along the second folding line 1041 (as indicated by arrow B in the FIG. 15). A force may also be applied to the back plate 105 to fold the first bearing plate 1053 and the second bearing plate 1054 along the fourth folding line 1051 (as indicated by arrow C in the FIG. 15). A force may also be applied to the kneeling plate 106 to fold the first kneeling plate 1063 and the second kneeling plate 1064 along the third folding line 1061 (as indicated by arrow D in the FIG. 15), allowing the two supporting side plates (101, 101') and the two armrest plates (102, 102') closer to each other along the X direction, reducing the distance between the two supporting side plates (101, 101') and the two armrest plates (102, 102') as shown in FIG. 16. Ultimately, the chair of the present disclosure is transformed into a folded shape as shown in FIG. 16, which greatly reduces the occupied volume, such that more folded chairs of the present disclosure may be accommodated in a limited storage space. In this process, the force is mainly applied to the pivots or the folding lines (1031, 1041, 1051, 1061) of certain components to allow easier bents and folds in a flat manner to other components. Furthermore, please refer to FIG. 16. Since the first supporting plate 1043 and the second supporting plate 1044 of the seat plate 104 are formed with handle hole 1047, when the first supporting plate 1043 and the second supporting plate 1044 of the seat plate 104 are folded, the two handle holes 1047 will be close to each other. Therefore, the user may hold and lift the folded multi-purpose folding chair 10 by hand, so as to facilitate moving the folded multi-purpose folding chair 10.

Figure 17B:
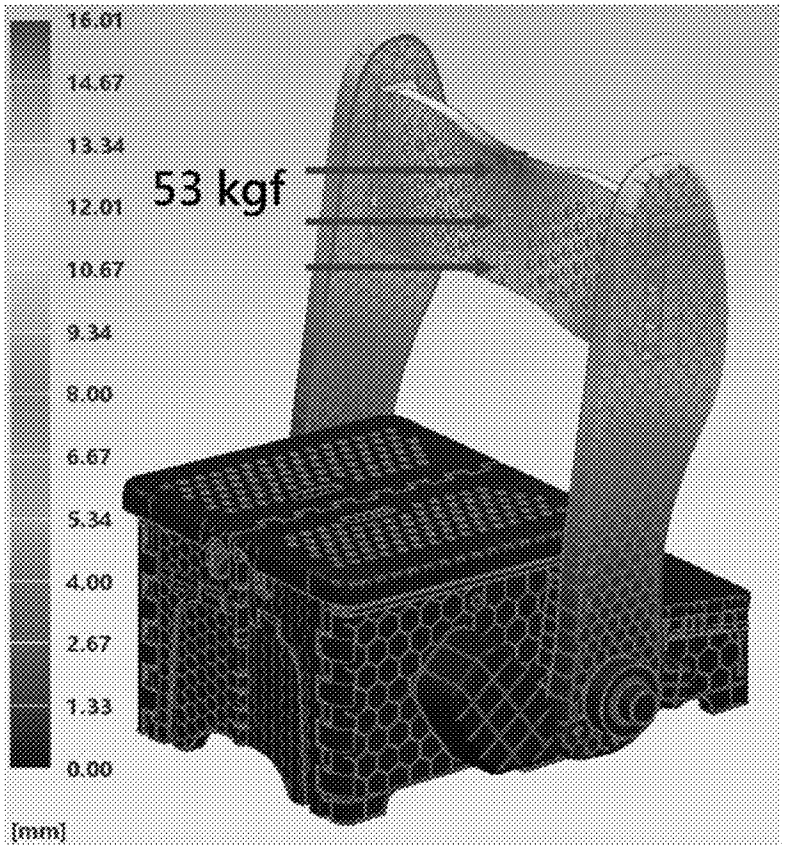
FIG. 17 A and FIG. 17 B are deformation distribution diagrams of a back plate of embodiment 1 and a comparative embodiment 1 after applying the same force.
Figure 17A:
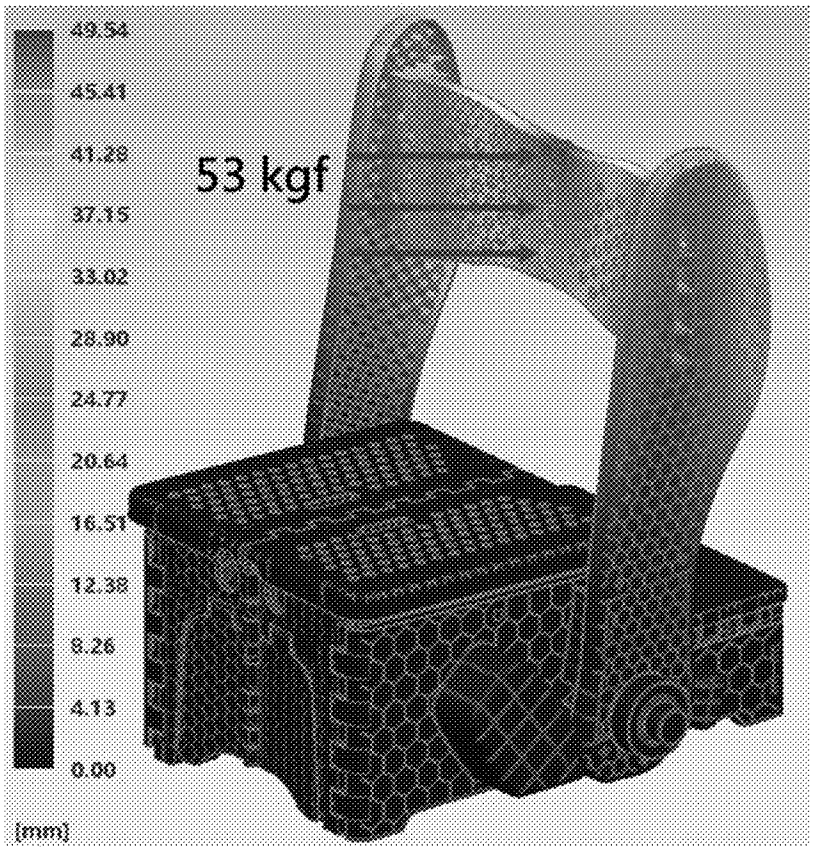

The Following are the Verification Results of the Back Plate and Seat Plate after Reinforcement:

Experiments were conducted on embodiment 1 and comparative embodiment 1 to test the compressive strength of back plates in accordance with the present disclosure. A weight of 53 Kgf was applied to the back plate of embodiment 1 (referred to the back plate 104 of the present disclosure, hereinafter referred to as the back plate 200) and the back plate 300 of comparative embodiment 1. The analysis was performed using computer-aided engineering (CAE) simulation methods. The results are shown in FIG. 17 A (embodiment 1) and FIG. 17 B (comparative embodiment 1).

The difference between the back plate 300 of the comparative embodiment 1 and the back plate 200 of embodiment 1 is that the back plate 300 of comparative embodiment 1 does not include the reinforcement structure and the reinforcing cover plate of the present disclosure. Additionally, the armrest plates do not include the reinforcing cover plate and the leaning part of the present disclosure.

TABLE 1

The maximum deformation value of embodiment 1 and comparative embodiment 1.

| | Embodiment 1 | Comparative Embodiment 1 |
|---|---|---|
| Maximum Deformation Value (mm) | 16.01 | 49.54 |

Referring to Table 1, the maximum deformation value of the back plate 300 in comparative embodiment 1 is 3 times higher than the back plate 200 in embodiment 1. This indicates that in embodiment 1, compared to comparative embodiment 1, the maximum deformation value of the back plate 200 is reduced, thereby the compression resistance is effectively improved.

Figure 18B:
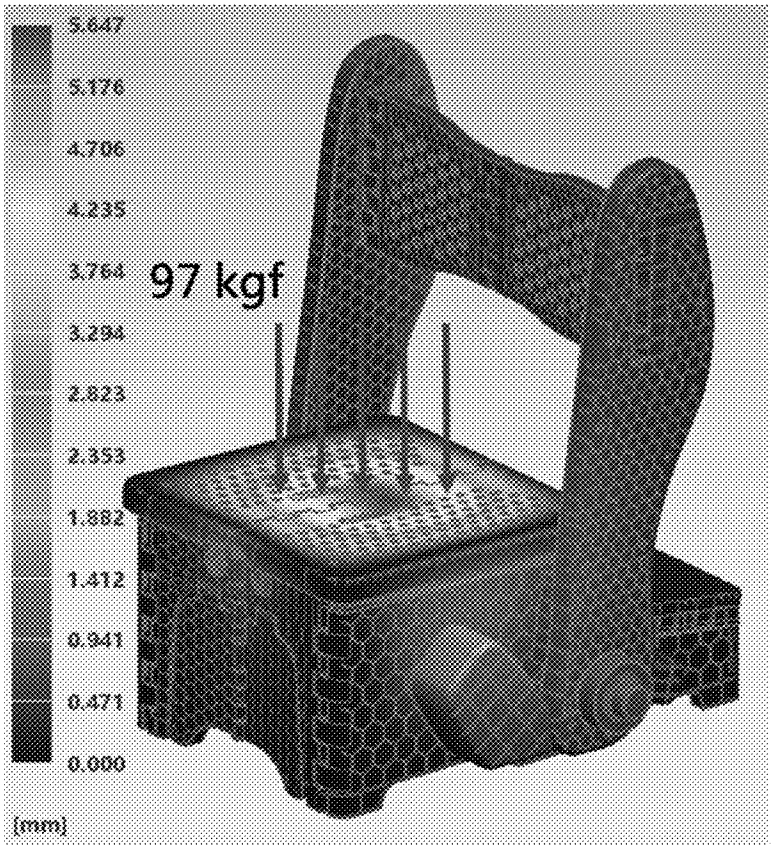
FIG. 18 A and FIG. 18 B are deformation distribution diagrams of a seat plate of embodiment 1 and a comparative embodiment 1 after applying the same force.
Figure 18A:
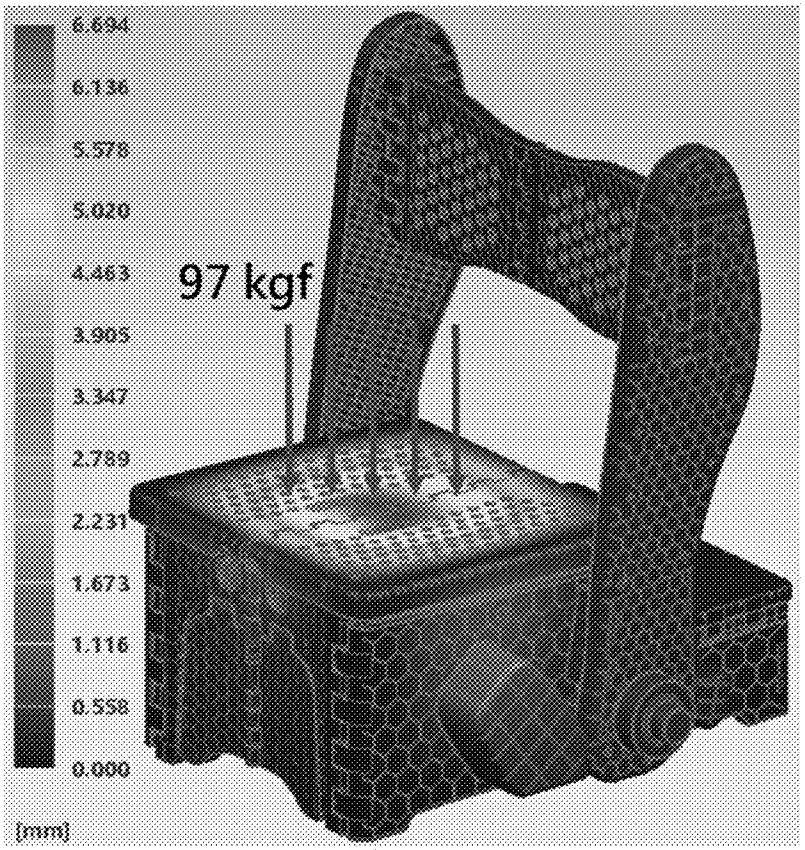

The seat plate of embodiment 1 of the present disclosure and comparative embodiment 1 were tested for compressive strength. A weight of 97 kgf was applied to the seat plate of embodiment 1 (referred to the seat plate 104 of the present disclosure, hereinafter referred to as the seat plate 400) and the seat plate 500 of comparative embodiment 1. The analysis was conducted using CAE simulation methods, and the results are shown in FIG. 18A (embodiment 1) and FIG. 18 B (comparative embodiment 1).

The difference between the seat plated 500 of comparative embodiment 1 and the seat plate 400 of embodiment 1 is that the seat plate 500 does not include a plurality of reinforcing ribs included in the reinforcement structure of the present disclosure.

TABLE 2

The maximum deformation value of embodiment 1 and comparative embodiment 1.

| | Embodiment 1 | Comparative Embodiment 1 |
|---|---|---|
| Maximum Deformation Value (mm) | 5.674 | 6.694 |

Referring to Table 2, the maximum deformation value of the seat plate 500 in comparative embodiment 1 is 1.18 times higher than the seat plate 400 in embodiment 1. This indicates that in embodiment 1, compared to comparative embodiment 1, the maximum deformation value of the seat plate 400 is reduced, thereby the compression resistance is effectively improved.

From the present disclosure, it is manifested that various techniques may be used for implementing the concepts described in the present disclosure without departing from the scope of those concepts. Moreover, while the concepts have been described with specific reference to certain implementations, a person of ordinary skill in the art would recognize that changes may be made in form and detail without departing from the scope of those concepts. As such, the described implementations are to be considered in all respects as illustrative and not restrictive. It should also be understood that the present disclosure is not limited to the particular implementations described above. Still, many rearrangements, modifications, and substitutions are possible without departing from the scope of the present disclosure.

What is claimed is:

1. A multi-purpose folding chair comprising:

two supporting side plates;

two connecting plates, each of the two connecting plates formed with a first folding line, the two connecting plates arranged between the two supporting side plates and pivotally connected to the two supporting side plates, such that the two connecting plates are foldable in a flat manner along the first folding line;

a seat plate formed with a second folding line, the seat plate arranged between the two supporting side plates, two sides of the seat plate respectively and pivotally connected to the two supporting side plates, and the seat plate is foldable in a flat manner through the second folding line; and a kneeling plate formed with a third folding line, two sides of the kneeling plate respectively and pivotally connected to the two supporting side plates, wherein at least one inner side of the two supporting side plates, the two connecting plates, the seat plate, or the kneeling plate is formed with a reinforcement structure, wherein each of the two supporting side plates is formed with a first rotating part, and the multi-purpose folding chair further comprises two armrest plates and a back plate, two ends of each of the two armrest plates are respectively formed with a second rotating part and a supporting part, the two armrest plates are respectively pivotally connected to the first rotating parts of the two supporting side plates through the second rotation parts, the back plate is formed with a fourth folding line, and the back plate is arranged between the two armrest plates, two sides of the back plate are pivotally connected to the supporting parts of the two armrest plates, the back plate is foldable in a flat manner along the fourth folding line, such that a distance between the two supporting side plates is reduced;

an inner side of each of the two armrest plates is formed with a limiting part, the two supporting side plates each having a corresponding surface corresponding to the limiting part is formed with a corresponding limiting part with a curved track, the limiting part slides against the curved track formed by the corresponding limiting part, such that the two armrest plates are rotatable relative to the two supporting side plates along the curved track, and each of the two connecting plates is foldable in a flat manner along the first folding line, the seat plate is foldable in a flat manner along the second folding line, and the kneeling plate is foldable in a flat manner along the third folding line, such that the distance between the two supporting side plates is reduced.

2. The multi-purpose folding chair according to claim 1, wherein each supporting side plate is formed with a first top supporting part and a second top supporting part, the first rotating part is between the first top supporting part and the second top supporting part, each of the first top supporting part and the second top supporting part limits a rotation angle of one of the two armrest plates.

3. The multi-purpose folding chair according to claim 1, wherein each of the two connecting plates comprises a first plate and a second plate, and each of the first plate and the second plate of each of the two connecting plates comprises an inner side formed with the reinforcement structure.

4. The multi-purpose folding chair according to claim 1, wherein the kneeling plate comprises a first kneeling plate and a second kneeling plate, and an inner side of each of the first kneeling plate and the second kneeling plate is formed with the reinforcement structure.

5. The multi-purpose folding chair according to claim 1, wherein a kneeling plate reinforcement plate is pivotally connected between the two supporting side plates, such that one side of the kneeling plate presses against the kneeling plate reinforcement plate.

6. The multi-purpose folding chair according to claim 1, wherein the reinforcement structure comprises:

a plurality of hexagonal reinforcement lattices arranged in a honeycomb shape; and a plurality of reinforcing ribs each intersects and connects between each of the plurality of hexagonal reinforcement lattices.

7. The multi-purpose folding chair according to claim 1, wherein at least one inner side of the two armrest plates and the back plate is covered with a reinforcing cover plate.

8. The multi-purpose folding chair according to claim 1, wherein a position where the two supporting side plates are pivotally connected to the kneeling plate comprises an inclination, the inclination is preferably at an angle of 8 degrees, and a plane of the kneeling plate is formed as an inclined plane after the kneeling plate is connected to the two supporting side plates.

* * * * *